United States Patent [19]

Gregory et al.

[11] Patent Number: 4,899,808

[45] Date of Patent: Feb. 13, 1990

[54] CONDENSING SURFACE FOR HEAT EXCHANGER WITH FINS ARRANGED TO DRIP CONDENSATE ONTO ONE SIDE ONLY

[75] Inventors: Edward J. Gregory, Wolverhampton; John Felton, Telford; Frank T. Cooper, Wolverhampton, all of England

[73] Assignee: Marston Palmer Limited, Fordhouses, England

[21] Appl. No.: 141,254

[22] Filed: Jan. 6, 1988

[30] Foreign Application Priority Data

Jan. 14, 1987 [GB] United Kingdom ..... 8700801

[51] Int. Cl.[4] ..... F28B 1/00

[52] U.S. Cl. ..... 165/1; 165/110; 165/166; 165/913

[58] Field of Search ..... 165/110, 111, 165, 166, 165/913, 152, 153, 1; 62/285, 290, 42

[56] References Cited

U.S. PATENT DOCUMENTS

| | | | |
|---|---|---|---|
| 1,969,439 | 8/1934 | Wentworth et al. | 165/152 |
| 2,011,853 | 8/1935 | Emmons | 165/153 |
| 2,285,225 | 6/1942 | Norris | 165/166 X |
| 4,182,410 | 1/1980 | Yoshida et al. | 165/166 X |
| 4,228,850 | 10/1980 | Sumitomo | 165/166 X |
| 4,648,441 | 3/1987 | van de Sluys et al. | 165/111 |
| 4,715,431 | 12/1987 | Schwarz et al. | 165/110 |
| 4,729,428 | 3/1988 | Yasutake et al. | 165/153 X |

FOREIGN PATENT DOCUMENTS

| | | | |
|---|---|---|---|
| 635688 | 9/1936 | Fed. Rep. of Germany | 165/166 |
| 1018691 | 1/1953 | France | 165/166 |
| 0089695 | 7/1980 | Japan | 165/110 |
| 132411 | 3/1948 | Sweden | 165/166 |
| 340866 | 7/1970 | U.S.S.R. | 165/111 |
| 1035398 | 8/1983 | U.S.S.R. | |
| 1570728 | 7/1908 | United Kingdom | |
| 521285 | 5/1940 | United Kingdom | 165/166 |
| 872255 | 7/1961 | United Kingdom | |
| 1256964 | 12/1971 | United Kingdom | |
| 1343175 | 1/1974 | United Kingdom | |
| 1375503 | 11/1974 | United Kingdom | |

*Primary Examiner*—Carl D. Price

*Attorney, Agent, or Firm*—Cushman, Darby & Cushman

[57] ABSTRACT

A heat exchanger particularly intended for condensing vapor from a gaseous stream in which there are provided fins so disposed that condensate forming on the fins drips onto one side only of the fins below it. This reduces the deleterious effect of the build-up of a liquid layer on fins which liquid layer reduces the thermal effectiveness of the fins.

7 Claims, 3 Drawing Sheets

CONDENSING SURFACE FOR HEAT EXCHANGER WITH FINS ARRANGED TO DRIP CONDENSATE ONTO ONE SIDE ONLY

BACKGROUND OF THE INVENTION

This invention relates to heat exchangers and has particular but not necessarily exclusive reference to plate fin heat exchangers and has particular reference to heat exchangers intended for condensing at least part of a vapour to form a liquid.

Heat exchangers are often used in circumstances where a cooling stream of vapour forms a liquid condensate which condenses onto surfaces containing or within the cooling stream. Although a great deal of effort has been expended on research and development into boiling surfaces for heat exchangers—where a liquid phase is being converted into a vapour phase—less effort has been directed heretofor towards condensing surfaces. To date, the principal mechanism for improving the effectiveness of condensing surfaces has been to provide channels or ridges in the condensing surface which lead the condensed liquid to discrete parts of the surface, leaving the remainder clear of liquid and therefore able to operate more efficiently. Such surfaces are commonly referred to as "Grigorig" surfaces. The theory behind such Grigorig surfaces is that the major resistance to heat transfer is that of the liquid film which forms as a result of condensation. By leading the liquid film to certain areas, the remaining portions of surface are free of thick liquid films and therefore are able to transfer heat more readily from the vapour to the surface.

The present invention is concerned with heat exchangers in which there are provided fins within the condensing path. The principle application of heat exchangers incorporating fins is in the so-called plate fin heat exchangers.

In a plate fin heat exchanger, there is provided a series of vertically disposed, spaced, parallel plates which form a series of discrete flow paths—the flow paths being further defined by side members. Between the plates, there are disposed a series of fins, normally corrugated fins, and the assembly may be clamped together or is preferably bonded together. Frequently, plate fin heat exchangers are made from aluminium or aluminium alloys and may be joined together by means of salt bath brazing or vacuum brazing. Plate fin heat exchanger constructions are well known per se.

SUMMARY OF THE INVENTION

By the present invention there is provided a heat exchanger having a first path or a first fluid which, in use, increases in heat content, and a second path or a second fluid which, in use, decreases in heat content, the heat exchanger being adapted and arranged to reduce the heat content of a second fluid, which includes vapour which condenses to form a liquid, characterised in that the second path includes a plurality of fins, which are so disposed that condensate forming on a first fin or set of fins upstream of and above a second fin or set of fins falls onto one side only of the second fin or set of fins.

The fins are preferably interconnected in the form of corrugations located between adjacent plates to form a plate-fin heat exchanger with the peaks and troughs of the corrugations in contact with or closely adjacent to the plates, and the fins being formed on the portions of the corrugations between the peaks and troughs.

The corrugations may be substantially square wave corrugations when seen in plan view. The lower edges of a block of the fins all extending to one side of the fins.

The fins may be in the form of corrugated sheets with the corrugations being arranged at angles one to the other. Alternatively, the ends of the fins may be deformed sideways so that liquid condensate from the first fin or set of fins falls only onto one side of the second fin or set of fins. Both ends of the fin may be deformed sideways.

The present invention also provides a corrugation for a plate fin type heat exchanger in which there is a plurality of slits in the corrugations between the peaks and troughs, the edges of the slits being deformed out of the plane of the material of the strips.

BRIEF DESCRIPTION OF THE DRAWINGS

By way of example, embodiments of the present invention will now be described with reference to the accompanying drawings of which.

DESCRIPTION OF THE PREFERRED EMBODIMENT

Figure 1:
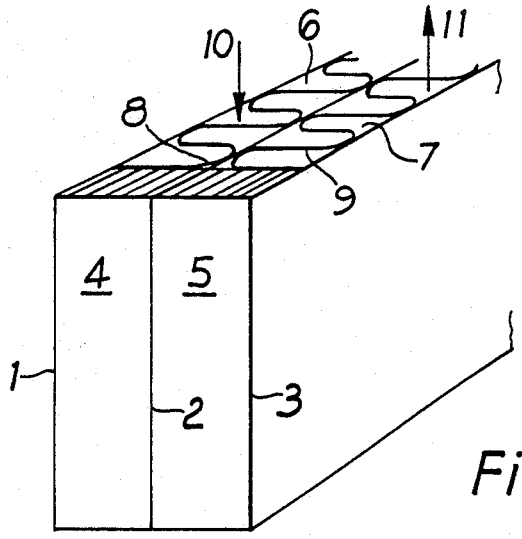
FIGS. 1 and 2 are schematic perspective views of a section of a plate fin type heat exchanger.

Referring to FIG. 1, this shows schematically a plate fin heat exchanger in which three plates 1, 2 and 3 are disposed in spaced arrangement with edge separators 4 and 5 holding the plates apart. The plates define a pair of flow paths 6, 7 with corrugations 8, 9 located in the flow paths. The flow path 6 is adapted to accept a downwardly passing stream of fluid 10 and the flow path 7 is adapted to accept an upwardly flowing stream of fluid 11. Suitable end stops and tanks are provided within the plate fin heat exchanger in a manner well known per se to enable the fluids to be passed through the heat exchanger as shown.

The fluid passing vertically downward through the heat exchanger is being cooled by the fluid passing upwardly through the heat exchanger. The fluid 10 contains products which, on cooling, will condense within the heat exchanger. Some or all of the fluid may be condensed within the heat exchanger. Normally, the cooling will reduce the temperature of the fluid, but, of course, when a vapour is condensing to form a liquid, heat content can be removed without change of temperature as the vapour phase changes state to the liquid phase. Condensation can occur either on the plates 1, 2 or on the corrugated fins 8.

Figure 2:
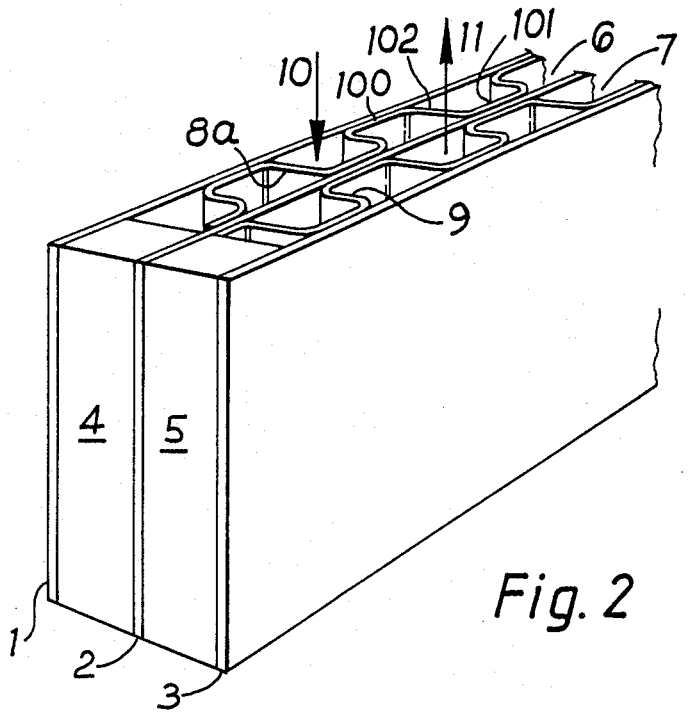

FIG. 2 shows a view similar to that of FIG. 1, save for the fact that the corrugation 8*a* is of substantially square cross-section when seen in plan view. This square wave corrugation has a portion 100 which forms a wave peak and a portion 101 which forms a wave trough. Between the peaks and troughs is a series of portions 102 which are substantially at right-angles to the plates 1 and 2.

The fins may have a shape as is shown more clearly in FIGS. 3 to 8.

Figure 3:
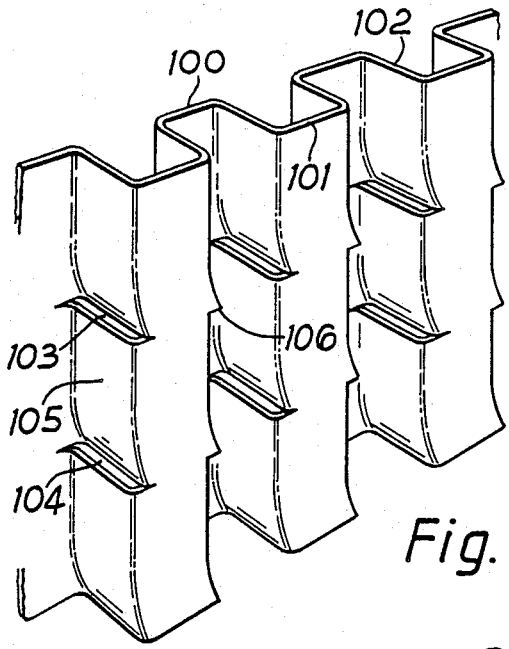
FIGS. 3 and 4 are perspective views of a form of fin.

Referring to FIG. 3, this shows the rectangular corrugation of the assembly of FIG. 2. The peaks 100 and troughs 101 are normally bonded to the plates 1, 2 in the conventional manner. Thus, corrugations strengthen the heat exchanger and help it resist internal pressures. In the fin shown in FIG. 3, the portions 102 of the corrugation which are between the peaks and troughs are slit at a series of transverse positions 103, 104. As a result of the slits, portions of the corrugations can be deformed so as to form slots. By deforming the material of the corrugations to the right at the bottom, as shown in FIG. 3, condensate moving down the fin drips from the right hand side of the corrugations and the face 105 is kept clear. It can also be seen from FIG. 3 that the edge 106 tends to ensure that the drops, in part, keep clear of the hidden face of the corrugation.

Figure 4:
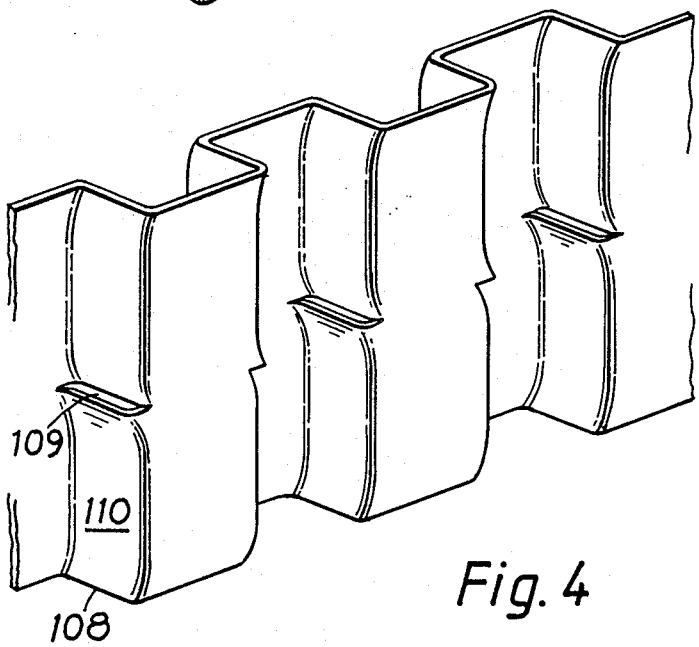

In the embodiments illustrated in FIG. 4, the edges 108, 109 are both deformed so that the portion 110 is kept clean of condensate. This deformation of the upper and lower sides of the fins is an alternative embodiment of the invention.

Figure 5:
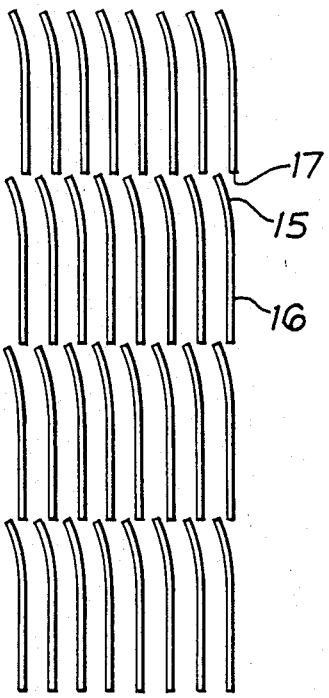
FIGS. 5 and 6 are sectional views of the corrugations similar to those shown in FIGS. 3 and 4, and FIGS. 7 and 8 are views of further alternative forms of fin.
Figure 6:
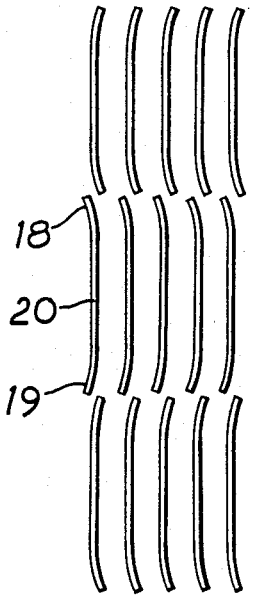

FIGS. 5 and 6 are cross-sections of fins similar to those illustrated in FIGS. 3 and 4 and it can be seen that the upper edges 15 of fin 16 are deformed to the left so that condensate dropping from edge 17 keeps clear of the left hand side of the fins. Similarly, in the embodiment illustrated in FIG. 6 both upper and lower edges are deformed at 18 and 19 to keep surface 20 clear. It will be appreciated that FIG. 6 corresponds to a cross-section of the corrugated fin shown in FIG. 4.

Figure 7:
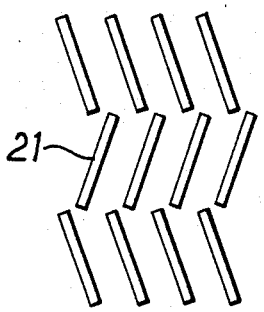
Figure 8:
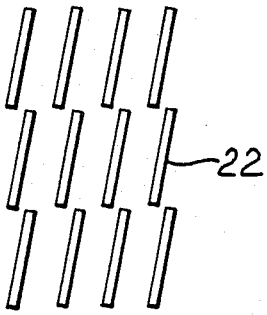

Alternatively, the fins may be inclined in a herring bone fashion as is shown at 21 in FIG. 7. Of course, the fins may be simply inclined as is shown in FIG. 8 at 22.

The plate fin heat exchanger may be constructed in a manner known per se, by example vacuum brazing or salt bath brazing. The vacuum brazed structure is preferred.

What is claimed:

1. A plate fin heat exchanger, comprising:

a series of at least three transversally-spaced, vertically-oriented plates facially confronting one another and comprising a first plate, a second plate and a third plate;

vertically-extending edge separator means closing spaces defined respectively between said first and second plates and between said second and third plates at laterally opposite respective portions of perimetrical edges of said plates;

a first corrugated element received in the space between said first plate, said second plate and the respective said vertically-extending edge separator means; said first corrugated element being corrugated and spatially arranged in a sense to provide, on opposite sides thereof, a plurality of vertically-extending first flow channels which are arranged in a first alternating series, with neighboring first flow channels being on opposite sides of said first corrugated element; said first flow channels being for a first stream of fluid to pass downwardly between said first and second plates to lose heat and thereby at least partially condense to produce a falling condensate;

a second corrugated element received in the space between said second plate, said third plate and the respective said vertically-extending edge separator means; said second corrugated element being corrugated and spatially arranged in a sense to provide, on opposite sides thereof, a plurality of vertically-extending second flow channels which are arranged in a second alternating series, with neighboring second flow channels being on opposite sides of said second corrugated element; said second flow channels being for a second stream of fluid to pass upwardly between said second and third plates to gain heat and thereby cool said first fluid by indirect heat exchange through said second plate;

said first corrugated element comprising peak portions disposed nearer said first plate, trough portions disposed nearer said second plate and angle portions joining respective peak and trough portions, in series, to provide said series of first flow channels;

said first and second flow channels having upper and lower ends passing fluid;

said first corrugated element, at at least one level intermediate said upper and lower ends of said first and second flow channels being provided with slits which extend through said first corrugated element in each of a plurality of said angle portions of said first corrugated element, thereby providing respective slit angle portions;

said slit angle portions being laterally deformed out of vertical registry above and below each said slit to such an extent that condensate dripping from both sides of each respective slit angle portion from above each respective slit will fall on only one side of such respective slit angle portion.

2. The plate fin heat exchanger of claim 1, wherein:

said slits are provided at each of a plurality of levels.

3. The plate fin heat exchanger of claim 2, wherein:

each slit angle portion is deformed above each slit to provide a respective lack of vertical registry above and below each respective slit.

4. The plate fin heat exchanger of claim 2, wherein:

each slit angle portion is deformed below each slit to provide a respective lack of vertical registry above and below each respective slit.

5. The plate fin exchanger of claim 2, wherein:

each slit angle portion is deformed both above and below each slit to provide a respective lack of vertical registry above and below each respective slit.

6. The plate fin heat exchanger of claim 2, wherein:

said first corrugated element is corrugated square wave-fashion, so that said angle portions extend substantially at right angles to said peak portions and trough portions of said first corrugated element.

7. A method of condensing a liquid from a gas, which includes the steps of:

cooling a gas by heat exchange with a coolant by passing the gas downwardly through a confined flow path, the flow path having confining walls and corrugated fins interconnecting at least one pair of opposed walls, the corrugated fins being discontinuous in a downward direction so that condensate formed on the fins as the gas is cooled falls from an upstream portion of the fin onto one side only of the downstream portion of the fin below said upstream portion, while cooling the confining walls by passing a coolant in heat exchange relation therewith.

* * * * *